United States Patent [19]

McKinney

[11] Patent Number: 5,044,525

[45] Date of Patent: Sep. 3, 1991

[54] DISPENSING DEVICE

[75] Inventor: James C. McKinney, Somerset, N.J.

[73] Assignee: Colgate-Palmolive Company, Piscataway, N.J.

[21] Appl. No.: 378,728

[22] Filed: Jul. 12, 1989

Related U.S. Application Data

[63] Continuation of Ser. No. 161,550, Feb. 29, 1988, abandoned.

[51] Int. Cl.[5] ..... B65D 88/54

[52] U.S. Cl. ..... 222/326; 222/340; 222/386

[58] Field of Search ..... 222/386, 386.5, 464, 222/560, 529, 326, 327, 328, 325, 340, 482, 582, 390, 256, 257, 259

[56] References Cited

U.S. PATENT DOCUMENTS

| | | | |
|---|---|---|---|
| 742,912 | 11/1903 | Schwechler | 222/326 |
| 966,861 | 8/1910 | Rubly | 222/326 |
| 1,291,447 | 1/1919 | Duncan | 222/386 |
| 1,319,264 | 10/1919 | Barnes et al. | 222/327 |
| 1,477,459 | 12/1921 | Skelly | 222/386 |
| 2,060,297 | 11/1936 | Fox | 222/256 |
| 2,224,967 | 12/1940 | Kaye | 222/326 |
| 2,305,158 | 12/1942 | Hanses | 221/102 |
| 2,434,505 | 1/1948 | Miller | 222/386 |
| 2,637,468 | 5/1953 | Wekerle | 222/328 |
| 2,649,999 | 8/1953 | Barch | 222/386 |
| 2,684,183 | 7/1954 | Werner | 222/127 |
| 2,714,473 | 5/1955 | Best | 222/217 |
| 2,759,640 | 8/1956 | Deupree | 222/326 |
| 2,772,033 | 11/1956 | Gerard | 222/340 |
| 2,792,154 | 5/1957 | L'Heureux | 222/340 |
| 3,034,687 | 5/1962 | Wiese | 222/340 |
| 3,043,484 | 7/1962 | Jolly | 222/335 |
| 3,174,657 | 3/1965 | Sundholm | 222/326 |
| 3,187,959 | 6/1965 | Morehouse | 222/326 |
| 3,211,340 | 10/1965 | Zander et al. | 222/95 |
| 3,255,935 | 6/1966 | Spatz | 222/340 |
| 3,940,029 | 2/1976 | Horvath | 222/340 |
| 3,951,310 | 4/1976 | Steiman | 222/95 |
| 4,136,802 | 1/1979 | Mascia et al. | 222/95 |
| 4,160,513 | 7/1979 | Cockerham | 222/181 |
| 4,196,828 | 4/1980 | Basile et al. | 222/340 |
| 4,437,591 | 3/1984 | Von Schuckmann | 222/391 |
| 4,511,068 | 4/1985 | Bossina | 222/257 |
| 4,598,843 | 7/1986 | Foster et al. | 222/153 |
| 4,657,161 | 4/1987 | Endo et al. | 222/256 |
| 4,664,299 | 5/1987 | Goncalves | 222/327 |
| 4,674,661 | 6/1987 | Herold | 222/386 |

FOREIGN PATENT DOCUMENTS

| | | | |
|---|---|---|---|
| 139375 | of 0000 | Fed. Rep. of Germany | 222/386 |
| 353306 | 3/1961 | Switzerland | 222/560 |

*Primary Examiner*—Robert P. Olszewski
*Assistant Examiner*—Kenneth Noland
*Attorney, Agent, or Firm*—Richard J. Ancel; Robert C. Sullivan; Murray M. Grill

[57] ABSTRACT

A dispenser, particularly useful as a pump for viscous material such as toothpaste has, in one embodiment, a body, a spout at the top of the body, a tube disposed vertically within the body aligned to register with the spout, a piston surrounding the tube below the top and a spring exerting continuous downward force on the piston so that the material to be dispensed which is located under the piston is forced up through the tube and out the spout when the spout is open. The spout may be of the turret type. Another embodiment comprises the same basic design, but it adapted to receive a refill container of the material. This Abstract shall not be construed to limit the scope of the specification, drawings or claims.

8 Claims, 3 Drawing Sheets

DISPENSING DEVICE

This is a continuation of co-pending application Ser. No. 07/161,550 filed on Feb. 29, 1988, now abandoned.

FIELD OF THE INVENTION

Dispensing devices for pasty and other viscous materials such as toothpaste pumps.

BACKGROUND

In recent years, dispensing devices for a wide range of pasty and viscous substances such as food products, e.g., cheese, etc., creams and for other materials have come into wide use. Especially popular are hand-held pumps which provide attractive, easy-to-use containers for use by consumers both at home and while travelling.

In particular, hand-held pumps for dentrifice materials such as toothpaste and gels (hereinafter referred to for convenience collectively as "pastes") have gained considerable consumer acceptance. They have become an alternative to tubes, but tubes are currently substantially less expensive than paste pumps now on the market.

Since pumps have properties many consumers prefer over tubes, it is believed that if a pump could be designed for manufacture at a cost equal to or less than tubes, sales of such a pump would increase substantially.

Pumps adapted for dispensing paste are generally found in Int. Classes G01F 11/00,B67D 5/32 in Class 222 in the U.S. Patent and Trademark Office. Representative thereof are the following U.S. Patents issued in recent years: U.S. Pat. Nos. 4,511,068; 4,598,843; 4,437,591; and 4,657,161.

It will be noted that the pumps disclosed in the foregoing Patents are relatively complicated, i.e., they have a relatively large number of components. As a consequence, since cost generally is a function of complexity and number of parts, these pumps are more expensive than desirable.

Moreover, it will be noted that all paste pumps currently on the market in the U.S. utilize an actuator mechanism which requires the application of pressure thereon by the user. These actuator mechanisms themselves are typically quite complicated. Certain pumps now on the market are connected to a rod which, in turn, is connected to a piston, i.e., movement of the actuator by hand pressure moves the rod which draws the piston against the paste to force the paste from the spout of the pump.

In addition, such current pumps are of the "draw up" type, i.e., the product to be dispensed is loaded above the piston and the piston, via the aforesaid means, is pulled up against the product to force it out of the pump nozzle.

Although such pumps generally function well, as indicated, because they are relatively complicated, they are relatively expensive.

Thus, an important object of this invention is to provide a new pump which is less complicated and therefore less expensive than those currently in use.

Another object of this invention is to provide a pump for paste products wherein the piston is located above the product to be dispensed and wherein there is provided a source of constant downward pressure on such piston so that the product is forced up a tube passing through the piston whereby, when the nozzle or spout is in registry with the tube, the product flows out continously until the nozzle is closed.

Another important object is to provide, in connection with the above combination, a rotatable turret type spout or nozzle which has an opening therein, and wherein the opening can be moved in and out of registry with the tube.

Another important object of the invention is to provide a pump which is refillable, i.e., to provide a "basic" pump which is designed to receive a refill container of paste and thereafter pump the contents of the container therefrom, whereby the consumer, having purchased one basic pump, is saved the cost of purchasing successive new pumps and is required only to purchase a refill container of paste, much as in the case of the system used in the home razor blade market, wherein once the consumer buys the razor holder, he or she need thereafter only purchase the refill blades.

Another key objective of this invention is to provide a "bottom heavy" pump which, in contrast to current paste pumps, maintains the material to be dispensed at the bottom of the container, thereby maintaining a low center of gravity so that the pump does not tip over. Current pumps draw the material to be dispensed upwardly, so that the center of gravity increasingly rises to the top of the pump, whereby the pump becomes top-heavy and tips over easily.

A further objective of this invention is to provide a refill container for hand-held dispensing devices, especially devices of the type of the present invention relating to pumps for pastes.

These and other objects of the invention will become apparent from the following detailed description, drawings and claims.

THE DRAWINGS

DETAILED DESCRIPTION

Figure 1:
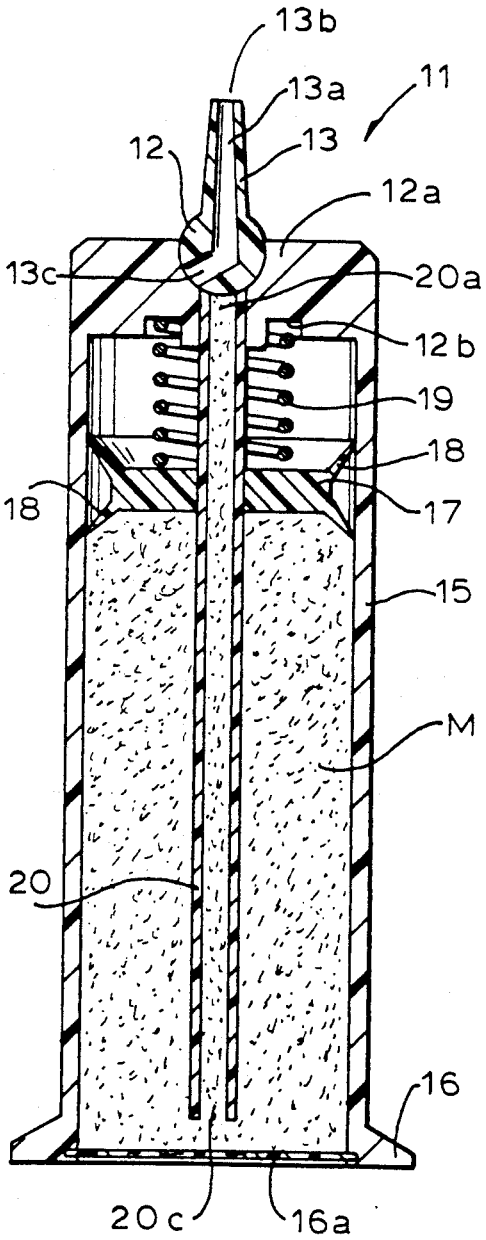
FIG. 1 illustrates one embodiment of the pump device of this invention in vertical cross-section in the fully loaded condition.

FIG. 1 shows a hand-held paste pump 11 having a turret-type nozzle or spout 13 at the top thereof. The nozzle includes a ball 12 rotatably seated within a housing 12*a*. Nozzle 13 has a spout portion connected to ball 12 movable therewith and includes a channel 13*a* terminating in a dispensing spout 13*b*. Channel 13*a* extends through ball 12 and terminates in a material receiving opening 13*c*.

Housing 12*a* is fitted to—and may be an integral part of—a container body 15 which has a base 16, the latter having a base cover 16*a*.

Disposed within container body 15 is a piston 17 with flexible side seals 18 which is vertically moveable in the body 15. A tube 20 which has an upper opening 20*a*, extends through piston 17 and has a lower opening 20*c*.

There is provided a compression spring 19, which may be helical, between the upper interior surface of body portion 12*b* and the top of piston 17, whereby spring 19 continuously exerts downward force on piston 17. Paste (or other previously mentioned viscous matter) M is loaded into the body of the pump below piston 17 and above bottom 16*a*. As shown in FIG. 1, material M is blocked from movement beyond the opening 20*a* of tube 20 by the surface of ball 12, but it will be observed tube 20 has been filled with paste by the downward pressure of piston 17 under force of spring 19 up through opening 20*c* in the tube 20.

Figure 2:
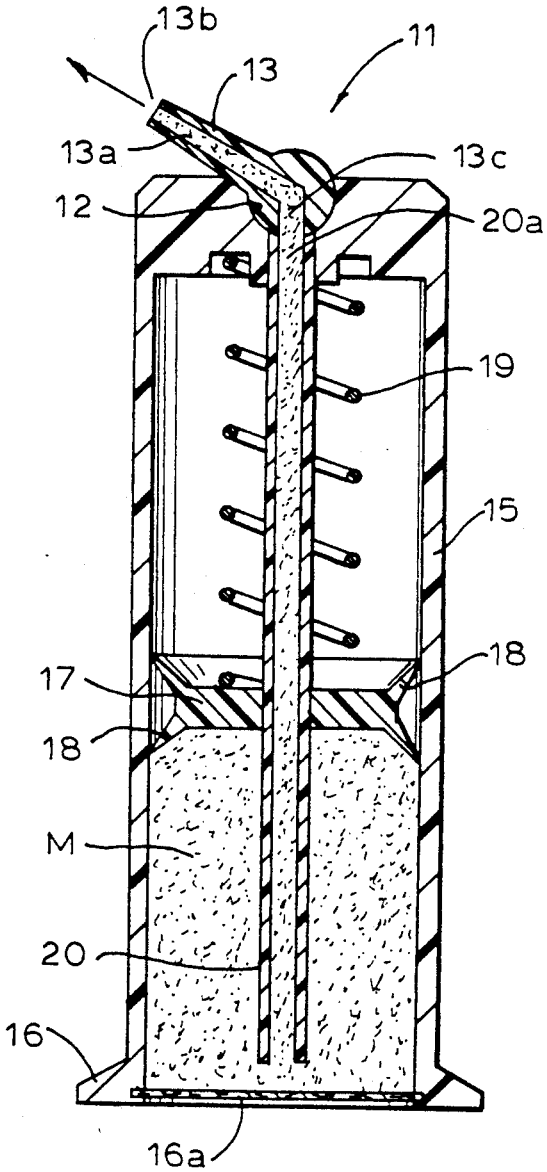
FIG. 2 illustrates another cross-sectional view of the device of this invention shown in FIG. 1 but with the contents partially emptied and the turret nozzle in the open position.

FIG. 2 shows the tube of FIG. 1 with the turret nozzle 13 in the open position, i.e., the user has rotated the nozzle to the left in FIG. 1 so that opening 13*c* of the tube channel is in registry with the opening 20*a* of dip tube 20, whereby the contents of the tube, M, are flowing continously from nozzle 13*b* as indicated by the arrow.

Thus, the embodiment illustrated in FIGS. 1 and 2 is remarkably uncomplicated and, in fact, comprises only five elements: A body, a nozzle, a piston, a dip tube and a spring (or other functionally equivalent means of exerting force), all of which have the further advantage of being easy to mold and assemble. By contrast, for example, the pump currently on the market sold under the Trademark "Crest" for tartar control paste has at least eight elements and represents an extremely complicated design which, presumably, is difficult to mold and assemble, and therefore relatively expensive.

Further, prior art pumps of the draw-up variety have a piston which moves upwardly within the pump housing to dispense the paste, so that the pump becomes increasingly top-heavy and therefore more likely to fall over. Sometimes this is merely an annoying inconvenience, but in the event the pump falls from, say, a bathroom sink onto a tile or other hard bathroom floor, the pump can be damaged.

In addition, paste pumps according to the present invention are very easy to fill with paste on a high-speed assembly line.

As indicated previously, it has also been discovered that pumps made in accordance with the present invention can be modified to be re-fillable, thereby even further increasing the cost-savings to the consumer.

Figure 3:
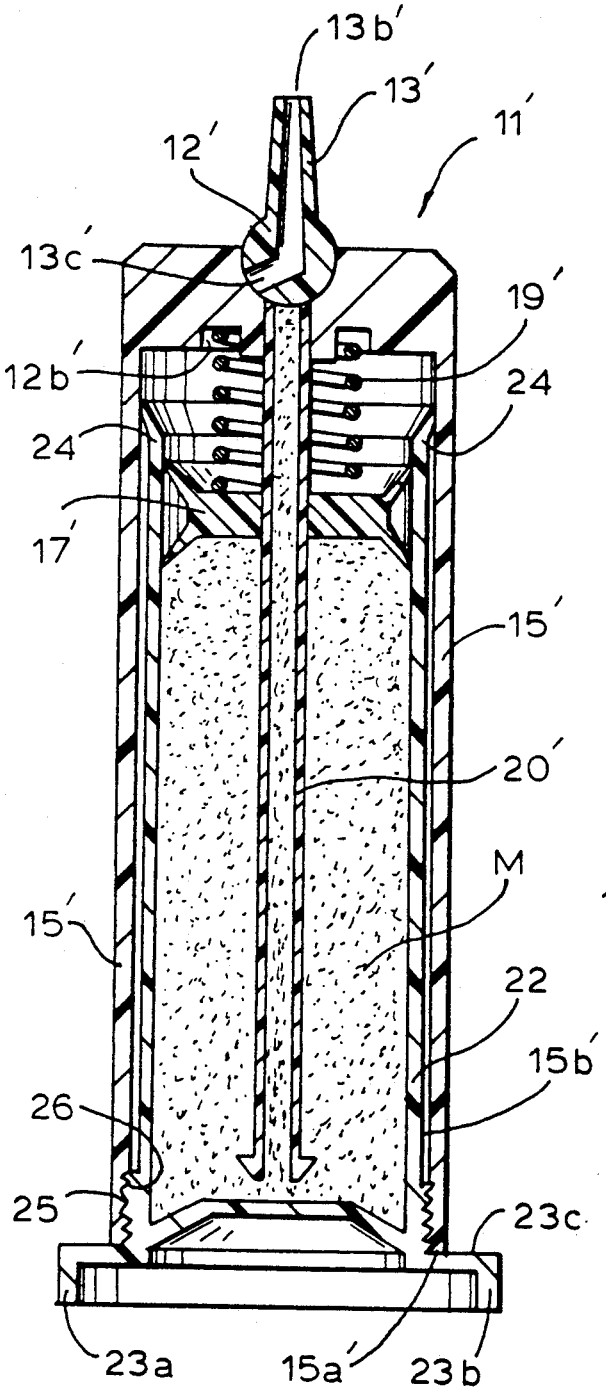
FIG. 3 is a vertical cross-section of another embodiment of this invention illustrating a refillable pump wherein the turret nozzle is in the closed position and the refill has just been fitted into the pump in a full condition.
Figure 4:
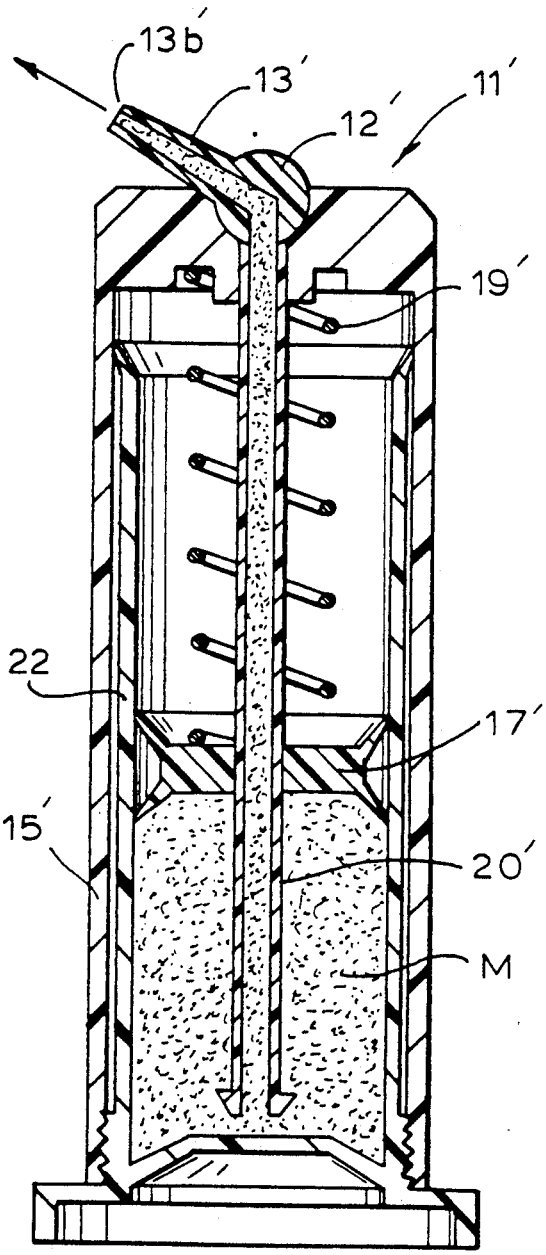
FIG. 4 is another cross-section of the pump of FIG. 3 in partially emptied condition after the insertion of a refill container, and with the nozzle in the open position discharging the contents of the tube.

One embodiment of a re-fillable pump is shown in in FIGS. 3 and 4 wherein parts identical or functionally equivalent to those shown in FIGS. 1 and 2 are marked with a prime, so that it is unecessary to specifically reiterate them here. In the embodiment of FIGS. 3 and 4, the body wall 15', preferably cylindrical in cross-section, terminates in an edge 15*a'* which defines an opening 15*b'*. Inserted into this opening is a refill container 22 with paste M already loaded therein. (Although not shown, it will be understood that container 22, as sold, will have a suitable cover which the consumer removes just before inserting container 22 within the pump 11'.)

Refill container 22 is inserted within pump 11' by threading it into the wall 15'. Thus, wall 15' has screw threads 26 on its inner surface adjacent bottom edge 15*a* and container 22 has matching threads 25 on its outer surface. Once container 22 is securely threaded into pump 11', the flared top portion 24 of the container 22 forms a tight seal against the inner surface of wall 15' above piston 17'. Similarly, the bottom surface 23*c* of container 22 preferably fits against the lower edge 15*a'* of the pump wall 15', thereby enhancing the seal provided by threads 25, 26 to provide a sealed compartment for the material M. The refill has feet 23*a* and 23*b* to provide a base for maintaining the assembly in an upright position.

FIG. 3 shows the refillable pump with its dispensing nozzle 13' in the closed position, while FIG. 4 shows such nozzle in the open position with the material M being discharged as indicated by the arrow.

Thus, in addition to the advantages of the pump shown in FIGS. 1 and 2, the pump of FIGS. 3 and 4 has the great benefit of being capable of utilizing refills, at substantial savings to the consumers.

Figure 5:
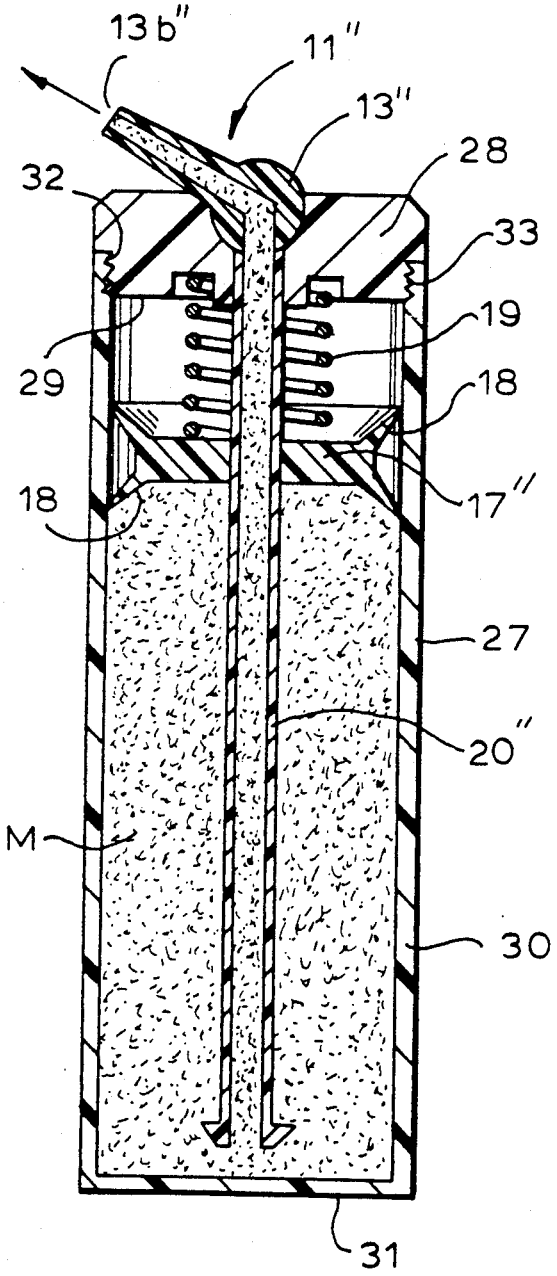
FIG. 5 is another embodiment of the combination pump/refill device of the present invention in vertical cross-section.

Another embodiment of a refillable container according to this invention is illustrated in FIG. 5 wherein the pump 11'' does not have a long body wall extending down the length of the container, but instead comprises what might be termed a head block 28 terminating in a lower edge 29. Just above the line of termination 29 the body 28 is provided with external threads 33. The latter are for the purpose of receiving a refill 27 which has a body wall 30 and threads 32 on the inner wall at the top which engage threads 33 of the body 28.

Refill 27 has a closed bottom end 31 and, as packaged for retail sale, will have its open top end closed by a cap, foil or other suitable cover which will protect the contents M and which may be easily removed just prior to attachment as described above.

It will be evident that the refill container 27 in FIG. 5, offers great advantages. In particular the consumer need only purchase the pump mechanism once and, thereafter, simply purchase the refill 27, thus saving the cost of buying an entire new pump on each occasion.

Figure 6:
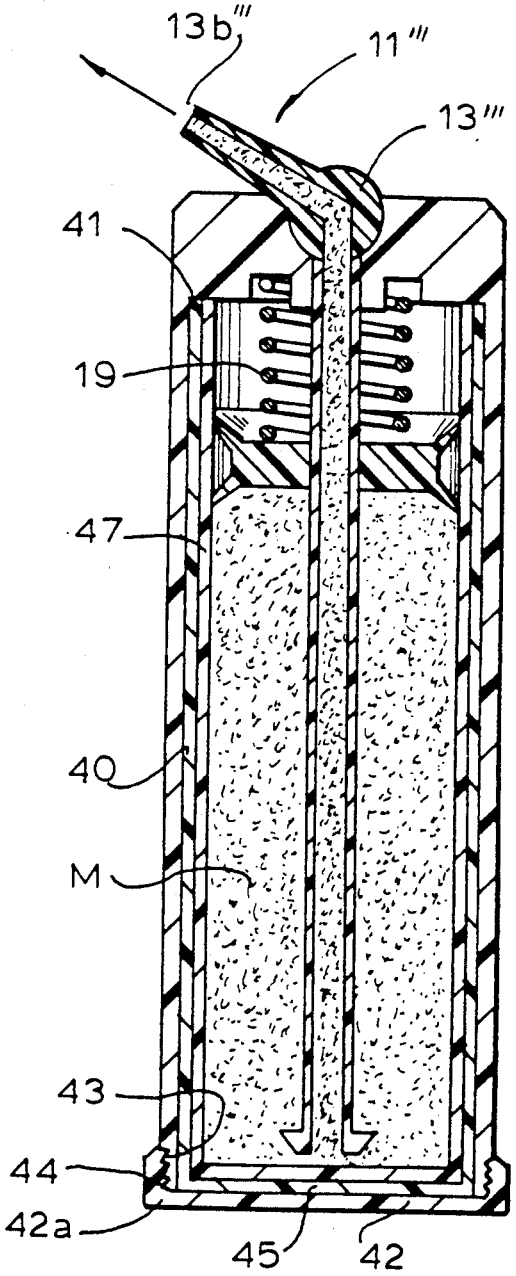
FIG. 6 is yet another embodiment of this invention taken in vertical cross-section.

FIG. 6 illustrates a pump 11''' which is similar in construction to pump 11 of FIG. 1. However, in the embodiment shown in FIG. 6, pump 11''' has an open bottom end equipped with external threads 43. These are designed to engage threads 44 on the inner surface of a lip 42*a* of a removable bottom cover 42. The purpose of this configuration is to permit the cover to be removed and the insertion of a refill 40, preferably a cylinder, containing paste M. Refill cylinder 40 has a closed bottom 45 and terminates in an open top end 41. The refill of FIG. 6 includes a multilayer structure 41, 47 preferably fabricated of a barrier material.

As in the case of the embodiment shown in FIG. 5, the invention of FIG. 6 offers similar substantial advantages in cost and product safety to both the consumer and manufacturer. Indeed, the refill 40 can be easily slid into the interior housing of pump 11''', and readied for instant use by attaching cover 42.

The refill containers thus described and illustrated should be considered as part of the present invention.

Moreover, the refills may take a number of different forms and comprise not only a refill container per se, but, if desired, may include a new piston, such as the piston 17'' in FIG. 5, in which case the original piston will be discarded.

In addition, the refills may be made of a wide variety of suitable materials. For example, currently sold toothpaste pumps employ polypropylene (PP) or polyethlene (PE) or polyethylene terephthalate (PET) or copolymers of PP and PE for the body walls of the pump which contains the paste and these body walls typically are relatively thick in order to prevent loss of flavorants, etc. through the body wall, which can occur when long shelf-life is required.

Alternatively, the refills shown herein can be made relatively thin and of said current materials, where long shelf-life is not needed. Or, where long shelf-life is desired, the refill may be made relatively thin and utilize so-called gas barrier materials, such as ethylene alcohol copolymer (EVOH), polyamides such as Nylon (PA), polyvinyildine chloride and copolymers thereof (PC), etc., which prevent the escape of flavorants or other components of the paste which can convert into a gas phase. These materials may be formed in a single layer, such as by extruding the same as a tube or by extrusion blow molding (EBM), the latter being more desirable since the bottom of the refill is formed in the mold, as well as the threads or other means of attachment. More preferably, these barrier materials are incorporated in a multiple layer structure which is extruded, again preferably by EBM coestrusion. This latter use of barrier materials formed into a refill is believed to be preferable particularly for refill 40 of FIG. 6.

Further, although only certain specific embodiments thereof have been shown and described, it is well within this invention that refill containers having the same inventive concept but different designs may be used.

For example, the particular means whereby the refill container is attached to the pump or inserted therein is, to some degree, a matter of choice.

Further, by way of additional modifications which are within the scope of this invention, the pump body may be other than circular in cross-section. For example, the body can just as well be square or rectangular in cross-section, in which case the re-fill would have the same cross-section and means other than screw threads would normally be employed.

I claim:

1. A dispensing device particularly adapted to dispense pasty materials, said dispensing device comprising a pumping section including a top portion; a nozzle movable between first and second positions, said nozzle having a channel with an inlet and an outlet and having a blocking surface, a tube extending from the nozzle through said top portion, said tube being secured to said top portion and having a channel with an inlet and an outlet, said tube outlet communicating directly with said nozzle inlet when said nozzle is in said first position and being blocked by said blocking surface of said nozzle when said nozzle is in said second position; a piston slidably disposed around said tube; and spring means disposed between said top portion and said piston, said device further comprising container means for housing the pasty material, and attaching means for removably attaching said container means to said pump section, said container means comprising a bottom portion and side portion which define an open interior portion for containing the pasty materials, said tube inlet communicating directly with with said open interior portion, whereby the pasty material in said open interior portion is discharged out said nozzle outlet by way of said tube when said nozzle is in said first position in response to the urging of said spring means.

2. The device of claim 1, wherein attaching means comprises interengaging threads on said container means and pumping section.

3. The device of claim 1, wherein the pasty material is a dentrifice.

4. The device of claim 1, wherein said pump section further comprises a body portion, said container means being adapted to slide into said body portion.

5. The device of claim 1, wherein said container means comprises a single layer structure.

6. The device of claim 1, wherein said container means comprises a multiple layer structure.

7. The device of claim 1, wherein said container means is formed of one or more polymeric materials selected from the groups consisting of PP, PE, copolymers of PP and PE, PET, EVOH, PA and PC.

8. The device of claim 1, wherein said container means comprises at least one layer of gas barrier material.

* * * * *